United States Patent [19]

Tang

[11] 4,325,110

[45] Apr. 13, 1982

[54] VASE-TYPE ILLUMINATIVE DEVICE

[76] Inventor: Woei S. Tang, 2F1., No. 1-1, Lane 129, Sec. 2 Chang-An East Rd., Taipei, Taiwan

[21] Appl. No.: 130,008

[22] Filed: Mar. 13, 1980

[51] Int. Cl.[3] ..... F21P 1/02

[52] U.S. Cl. ..... 362/806; 362/122; D6/137; D6/182; D11/143

[58] Field of Search ..... 362/806, 122; D11/143; D6/137, 182

[56] References Cited

U.S. PATENT DOCUMENTS

| | | | |
|---|---|---|---|
| 1,758,130 | 5/1930 | Shoemaker | 362/806 |
| 2,631,409 | 3/1953 | Windiate | 362/122 |
| 2,709,217 | 5/1955 | McCluskey | 362/122 |
| 3,207,892 | 9/1965 | Nikoll | 362/806 |

*Primary Examiner*—Benjamin R. Padgett

*Assistant Examiner*—Irwin Gluck

*Attorney, Agent, or Firm*—Armstrong, Nikaido, Marmelstein & Kubovcik

[57] ABSTRACT

The present invention relates to one kind of improved vase-type illuminative devices comprising such component parts as transparent container, transparent base board, supporting stand and illuminating mechanism, in which the transparent base board can be either movably or immovably mounted on the underside of the said container, while the flowers or various kinds of ornaments are inserted in place into the holding hole on the base board, and is characterized by that apart from providing the idealest lighting effect, it achieves a most satisfactory adorning result by means of filling hued liquid through the upper portion of the container or the transparent base board, and by installing fixed bulbs or rotatable chromatic light source on the upper or lower side of the container.

15 Claims, 10 Drawing Figures

FIG. 2A
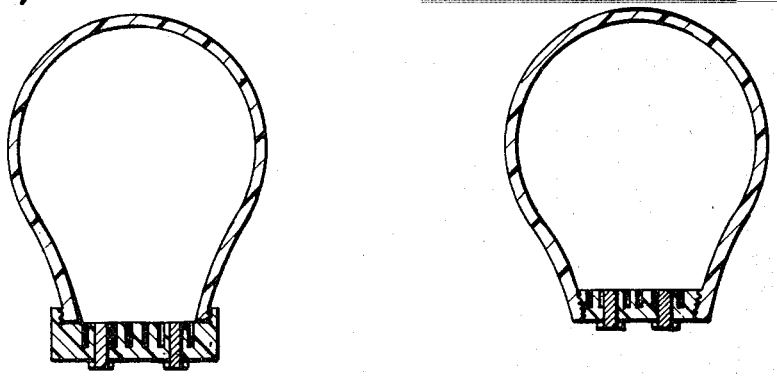
FIG. 2B
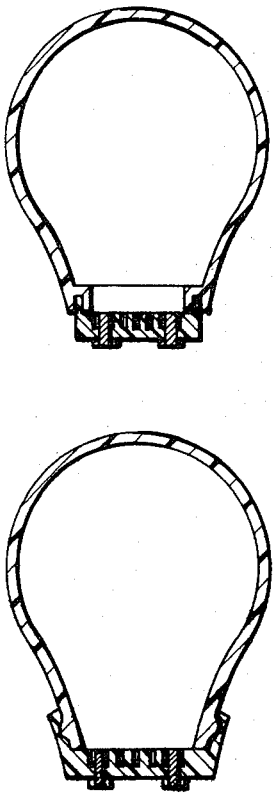
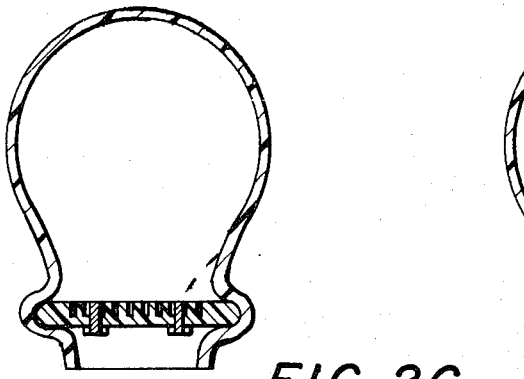
FIG. 2C

VASE-TYPE ILLUMINATIVE DEVICE

BACKGROUND OF THE INVENTION

In general, the contemporary flower vases are mostly made of opaque materials such as procelain, marble, enamal, etc. and filled with water to preserve the freshness of the flowers held upright therein. Such kind of vases adapt to interior decoration, nevertheless the insufficient lighting and poor ventilation indoors considerably discount the pleasure of sight that the flowers can offer. However, provided such vases are removed outdoors, the bright living flowers will inevitably incur the contamination of the dust-rich urban air, and appear only dull and matted in color. Moreover, in conventional types of vases, the visible portion of a bundle of flowers held thereby is confined to what rises above the margin of opening of the vases instead of a whole bundle, and in this regard they will become functionless in case the flower stems are too short to be held in place.

As far as the flower-arranging plates frequently seen are concerned, nor can their displaying function in terms of interior decoration be said satisfactory not only because the shallow reservoir due to their dwarf figuration resting flat on the table allows only limited water be stored therein, but also because the way flowers held in position is exclusively performed by securing the flower stems onto a number of spikes pointing upward constructing a nail-bed-like base which is liable to injure the vulnerable stem of cut flowers especially those succulent, herbaceous ones such as gladiolus, lili, daisies, etc. Moreover such way of standing flower does not always ensure a secure positioning, in other words, the flowers are tend to lean askew or aside and appear only unduly awkward. When such flower-arranging devices are placed in a place subjected to motions such as vehicles, trains, airplanes or ships, high causion must be taken to avoid them falling off on the deckboard and being broken thereon, if not that bad, the reserved water may still be splashed out and renders much trouble, therefore their application is much limited.

About the art lamps frequently appear in families as well as in some public occasions, the hue and patterns are usually encaustically printed on the glass lamp shade and the scene is thus displayed in our sight by passing the lamp light through the patterned lamp shade. Inasmuch as both the hue and patterns are all geometrically planar, they fail to create a solid and stereoscopic sence thus lack realism. Further, since the light is directly emitted from the bulb and pass through a mere layer of glass, if we stare at such art lamps directly, the glare may dazzle our eyes.

Accordingly, it is the aim of this invention to develop an ornamental, illuminating device combining all the merits of the aforesaid conventional vases, flower-arranging plates and art lamps yet free of their said defects.

It is the major object of this invention to provide one kind of improved vase-type illuminative devices, of which the container for holding flowers or ornaments is substantially transparent, and the said flowers or ornaments are thus made to appear lifelike when a beam of light is projected from either a fixed lamp or a colored light source through the container, outlines the flowers and ornaments and creates an undescribably charming atmosphere out of such seemingly plain articles.

As the light has been obscured and diffused by the flowers and the ornaments in advance before coming into our sight, it appears only agreeable soft, and neither dazzles our eyes nor disturbs a bit of the pleasure of sight, hence it can make the best of both its illuminating and ornamental function.

It is another object of this invention to provide one kind of improved vase-type illuminative devices, of which the container can be so designed as to fit the growing condition of the flowers to match the background of ornaments, and to meet the requirement of interior decoration by filling said container with liquid of various colors to make an appearance of crystal-like, stereoscopic structure to create a sense of unusual luxuriousness and undes-cribable beauty. Again, with the flowers and ornaments standing out against the background pervaded by a charming atmosphere created by the colorful liquid and the illumination of the fixed or chromatic light source, a marvelous, flickering and twinkling effect is therefore attained, and makes us perceive the coloration shift throughout all the seasons of an whole year thereform. Further, due to the existence of the hued liquid, the petals is tend to flutter therefore make it appear more lifelike and beauteous.

It is a further object of the present invention to provide one kind of improved vase-type illuminative devices, of which the vase is so designed that it can be either conveniently dismounted or mounted. On the base board, there are provided with two water inlets for feeding water thereinto which can be freely closed by stoppers or screwed covers, and a single or a plurality of holding holes for insetting the flowers or other ornaments upstanding therein which provide an optimal way of securing the flowers in place duly and safely without harming the fragile flower stem.

It is still a further object of this invention to provide one kind of improved vase-type illuminative devices, of which the base board of the container can be installed a sucker disc to cling onto the table or corresponding objects that are subjected to move, to secure it in place and prevent it from falling down and being broken. Said sucker can also be mounted on the side of the vase to attach onto walls sideways.

It is a further object of this invention to provide one kind of improved vase-type illuminative devices, whereof the transparent base board equipped with flowers or ornaments can be rotated through a shaft transmitting the torque yielded by motor to the base board to attain a natural, stereoscopic and dynamic sense in accompany with the illuminating effect provided by the fixed or colored light source.

It is a further object of this invention to provide one kind of improved vase-type illuminative devices, of which the applied illuminating mechanism can be either a single light source or multicolored ones insomuch that it can harmonize with various kinds of occasions suitably to accomplish different preferred effects. The illuminating mechanism can be mounted on either the upper part or lower part of the container depending on the practical conditions, to adapt to various kind of necessity in different situation.

It is still a further object of this invention to provide one kind of improved vase-type illuminative device adaptively applicable to different occasions as mural ornaments, ceiling ornaments and outdoor illuminating ornaments etc. without the trouble of being disturbed by wind, rain, sunlight and contaminated by dust so as to successfully arrest the attention of people wherever and whenever.

SUMMARY

The present invention relates to one kind of devices embracing both functions of conventional flower vases and art lamps, and more particularly to that provides ideal lighting as well as displays most satisfactory decorative result. In other words, it includes both practical and beautifying effects.

Numerous other features, objects, and advantages of the invention will become apparent from the following specification when read in connection with the accompanying drawing in which:

BRIEF DESCRIPTION OF THE DRAWINGS

FIG. 2 is a graphical representation showing the proposed three examplary methods of the connection of the transparent container and its base board;

DETAILED DESCRIPTION OF THIS INVENTION

Figure 1:
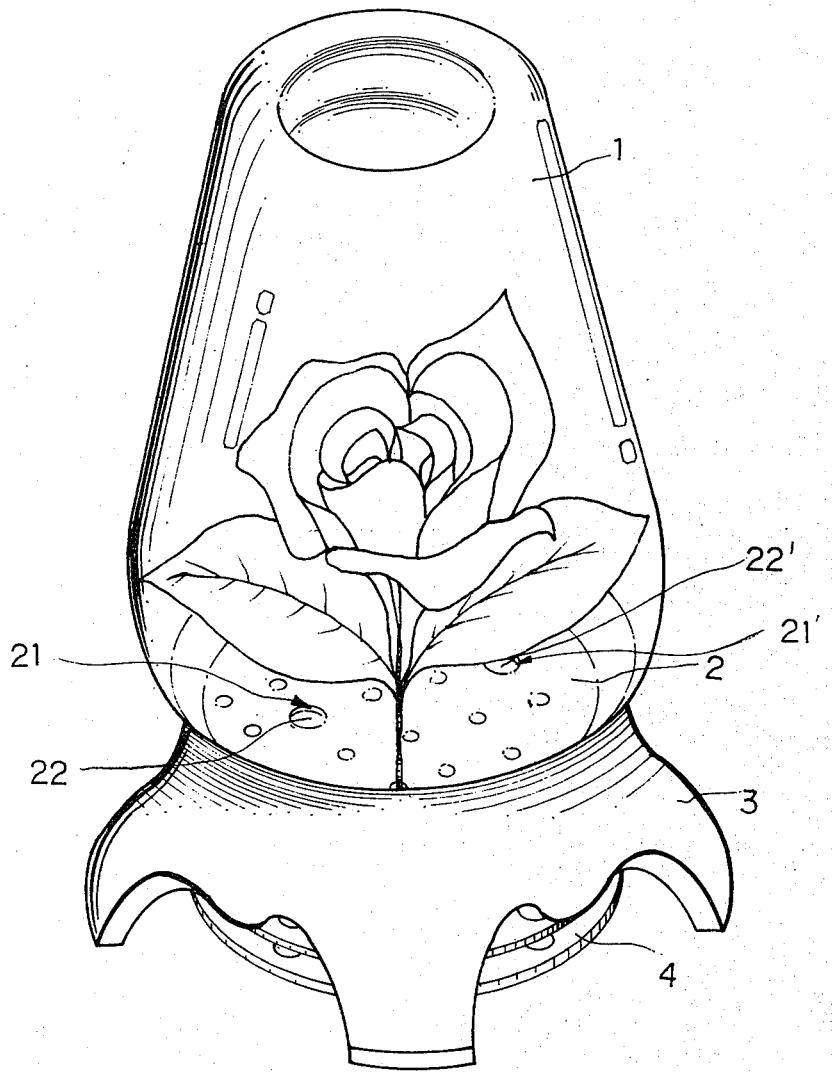
FIG. 1 is the perspective view of this invention.
Figure 3A:
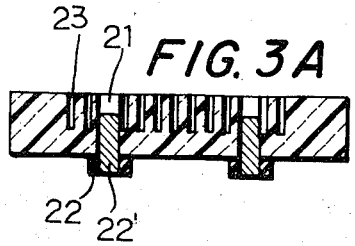
FIG. 3 is another embodiment of the base board of this invention.
Figure 3B:
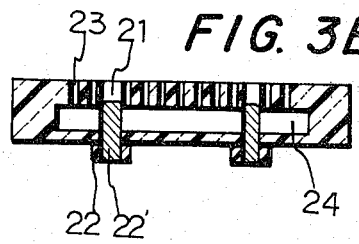
Figure 3C:
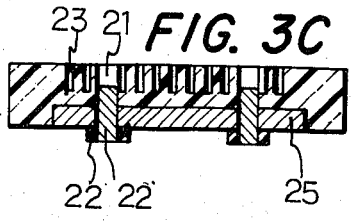

With reference now to the drawing, and more particularly FIG. 1 thereof, the invention is seen comprising four main parts such as transparent container (1), transparent base board (2), supporting stand (3), and illuminating mechanism (4), in which said transparent base board (2) can be either stationarily fixed or movably mounted on the bottom portion of transparent container (1), while the function of supporting stand (3) provides the connection of transparent container (1) and illuminating mechanism (4). The underside of transparent container (1) is the base board (2) that can be dismounted freely yet is still closely engaged with the container in a watertight manner and allows no exudation of the liquid held therein. On the base board there is provided with two water inlets (21) (21') closed by either stoppers or screwed covers (22) (22') for charging or discharging water. The portion for holding flowers or for installing other kinds of ornaments of the base board can be designed as seen in the embodiment of FIG. 3. A plurality of holding holes (23) is set on base board (2) as shown in FIG. 2 which protect the flower stem from being hurt. Besides, such holes still provide a safer and more convenient way of holding flowers and other ornaments in position. FIG. 3(B) is another embodiment in which the base board is equipped a water trough (24) below holding holes (23). The internal space of the former intercommunicate with the latter through which the flower is secured, thus the sealed water in the water trough will not be splashed out by rocking or jolting. In the embodiment of FIG. 3(C), there is prepared a heavy metallic block below the holding holes.

Since the base board of this invention can be separably used, when applied to watery places such as an aquarium or a family pool, the base board (2) together with the flowers or ornaments held thereon, are kept in place without floating on the water by the gravity of said metallic block.

Figure 3D:
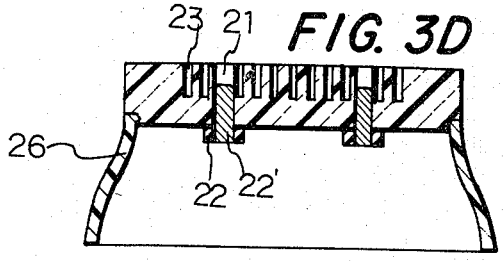
Figure 4:
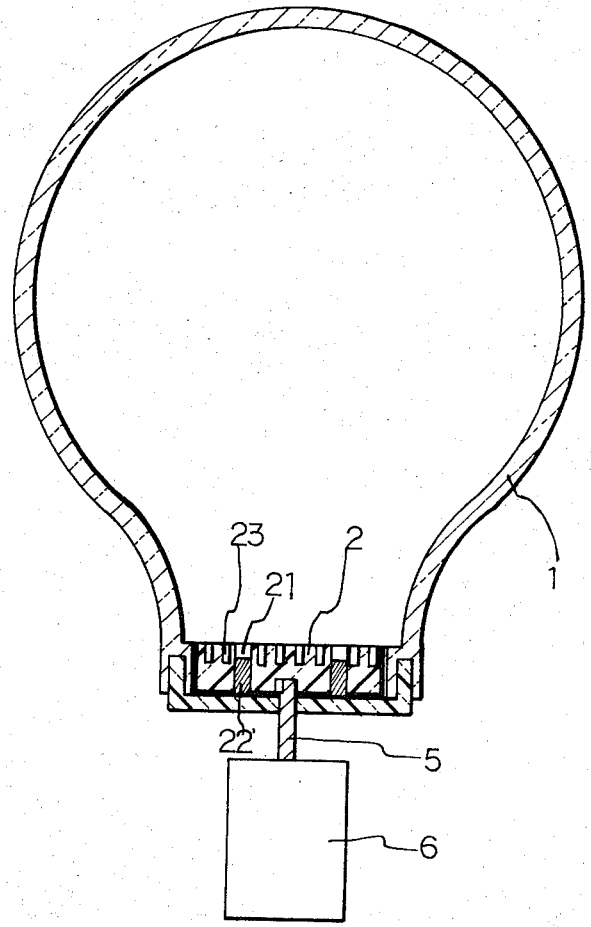
FIG. 4 is the sectional view of the rotatable device of the base board of this invention.
Figure 5:
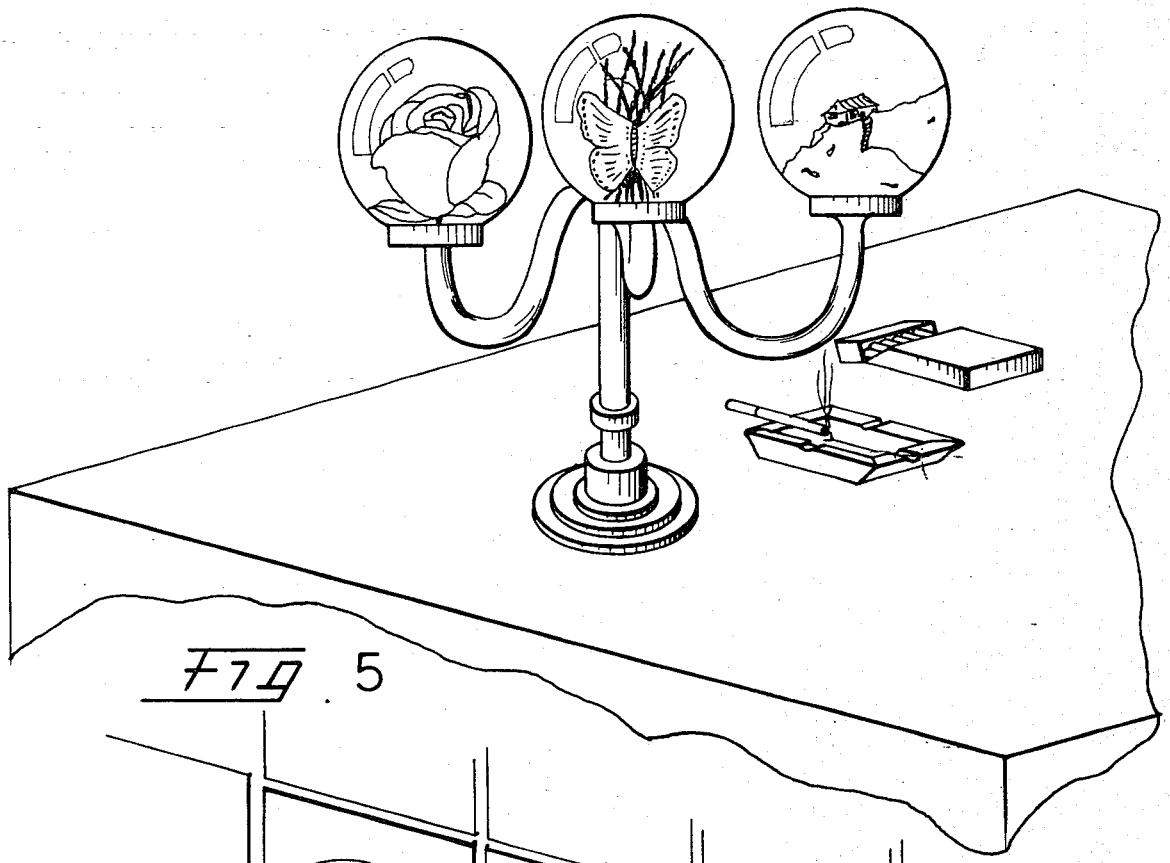
FIG. 5 is an embodiment of this invention functioning as a table ornament.

In FIG. 3(D) there is shown an embodiment of this invention in which the accessory is a sucker installed on the underside of base board (26) to cling onto the table or other objects subjected to frequent motions such as vessels, trains, motorcars, airplanes, etc.

Referring to FIG. 2, both the transparent container (1) and the base board (2) of this invention have several ways of engagement. We hereby propose three preferable ways, in FIG. 2(A) it is performed by the screw thread on the connecting portion, in FIG. 2(B), glue is applied to adhere both parts together instead, whereas in FIG. 2(C), the fastening effect is achieved by the constrictive force exerted by the rubber loop around said container. However all the foregoing preferred, examplary methods only provide help to understand this invention, and do not limit the boundary thereto.

Figure 6:
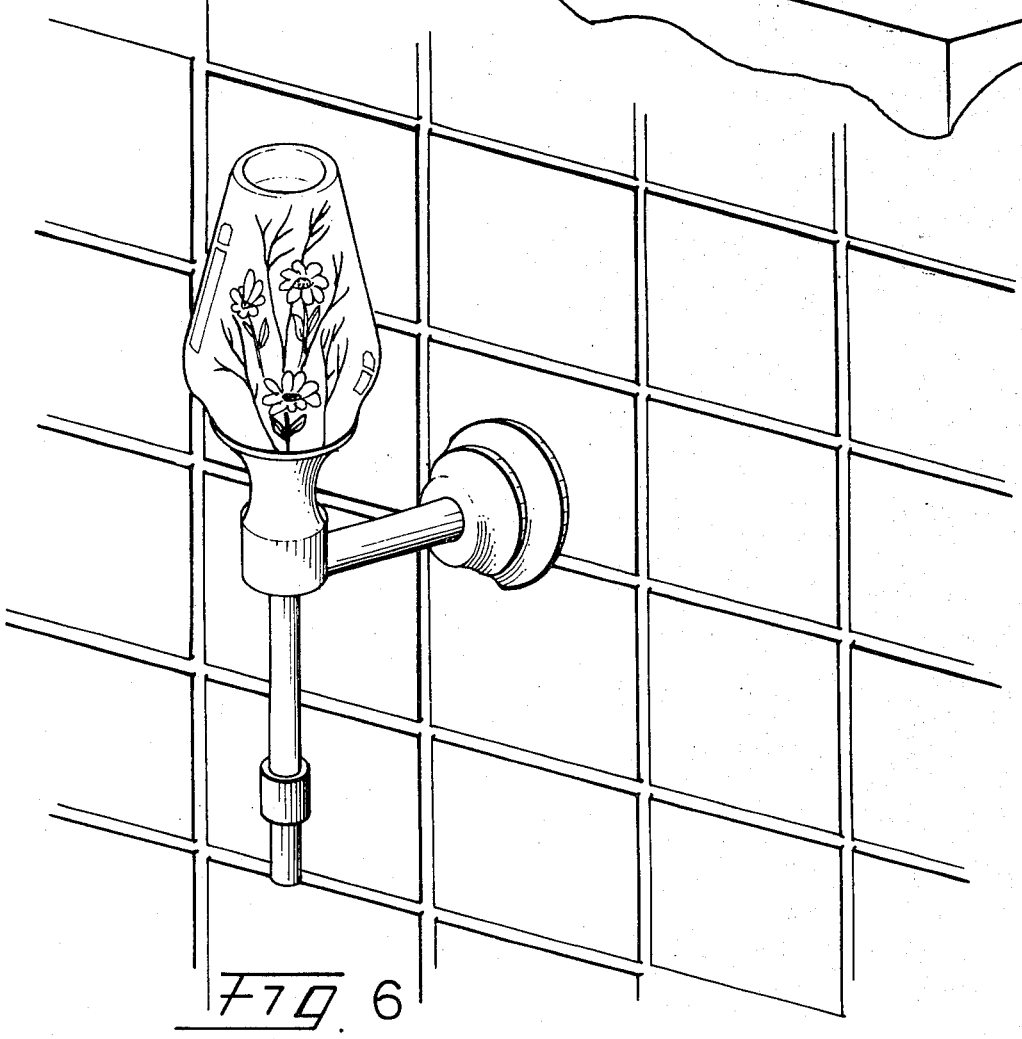
FIG. 6 is an embodiment of this invention acting as wall ornament.
Figure 7:
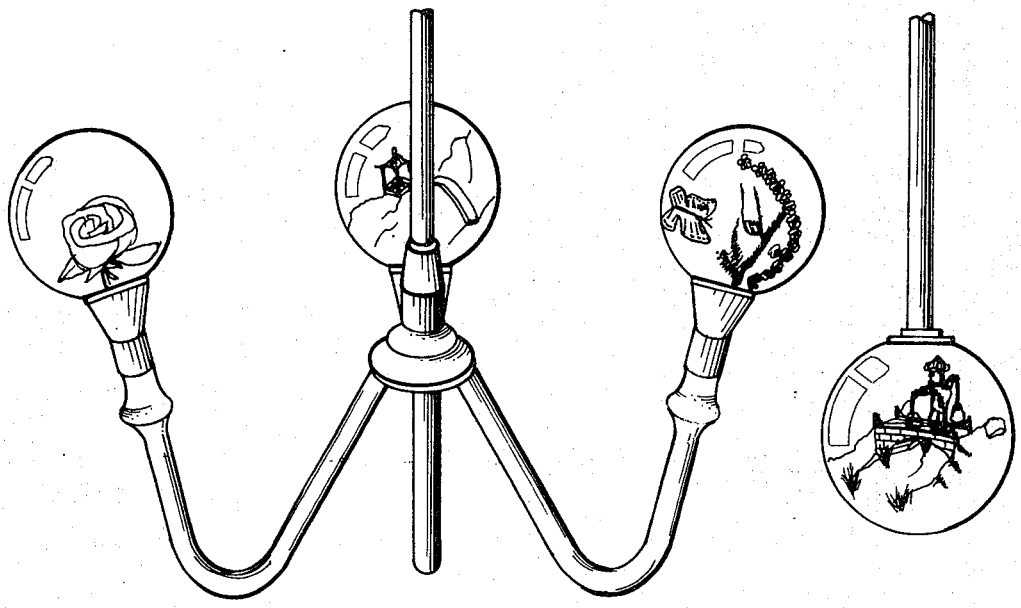
FIG. 7 is an embodiment of this invention acting as a ceiling ornament.
Figure 8:
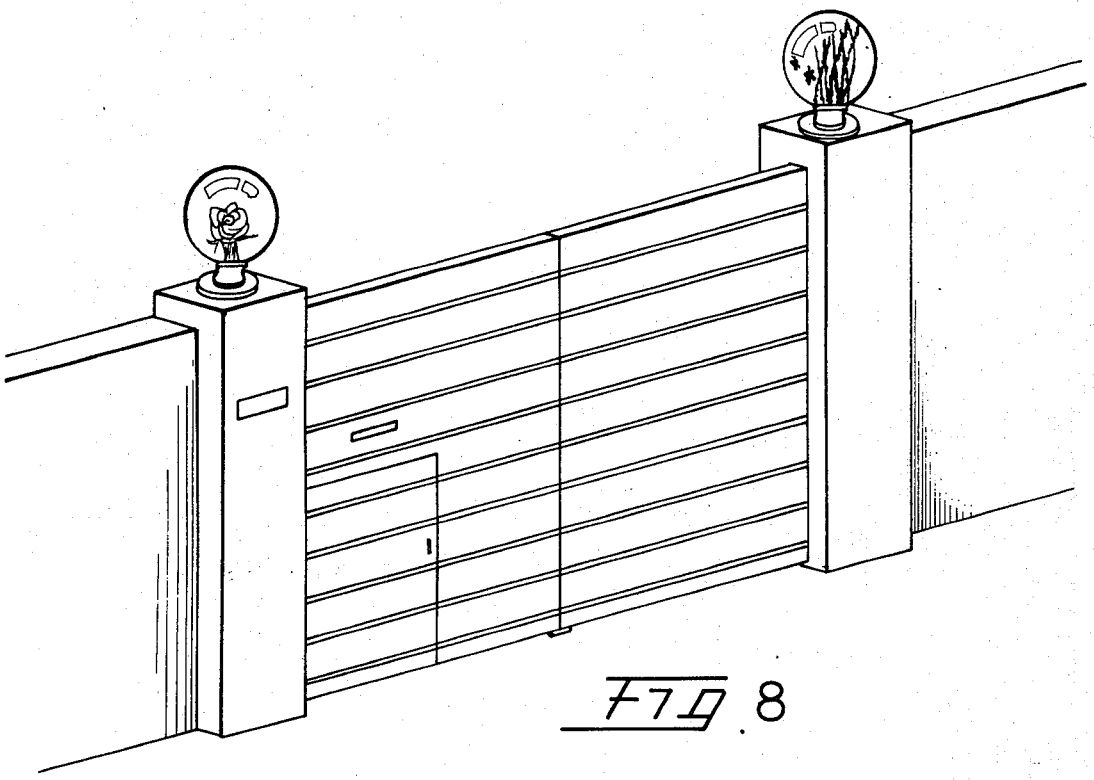
FIG. 8 is an embodiment of this invention acting as a gate light.
Figure 9:
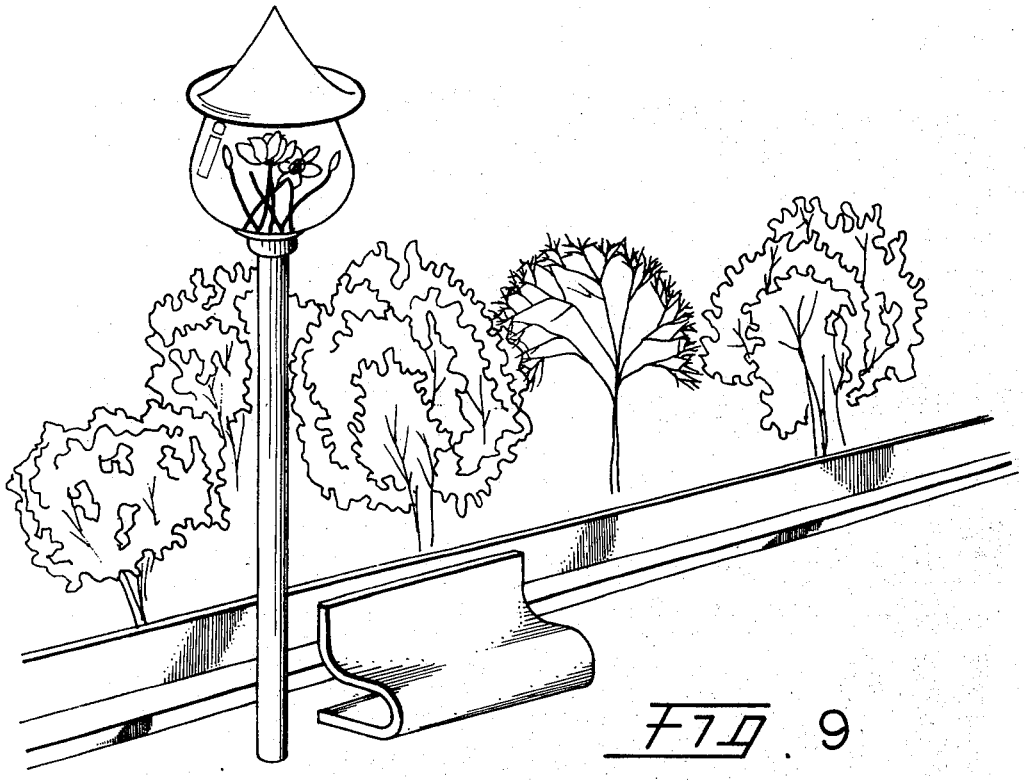
FIG. 9 is an embodiment of this invention acting as a street light.
Figure 10:
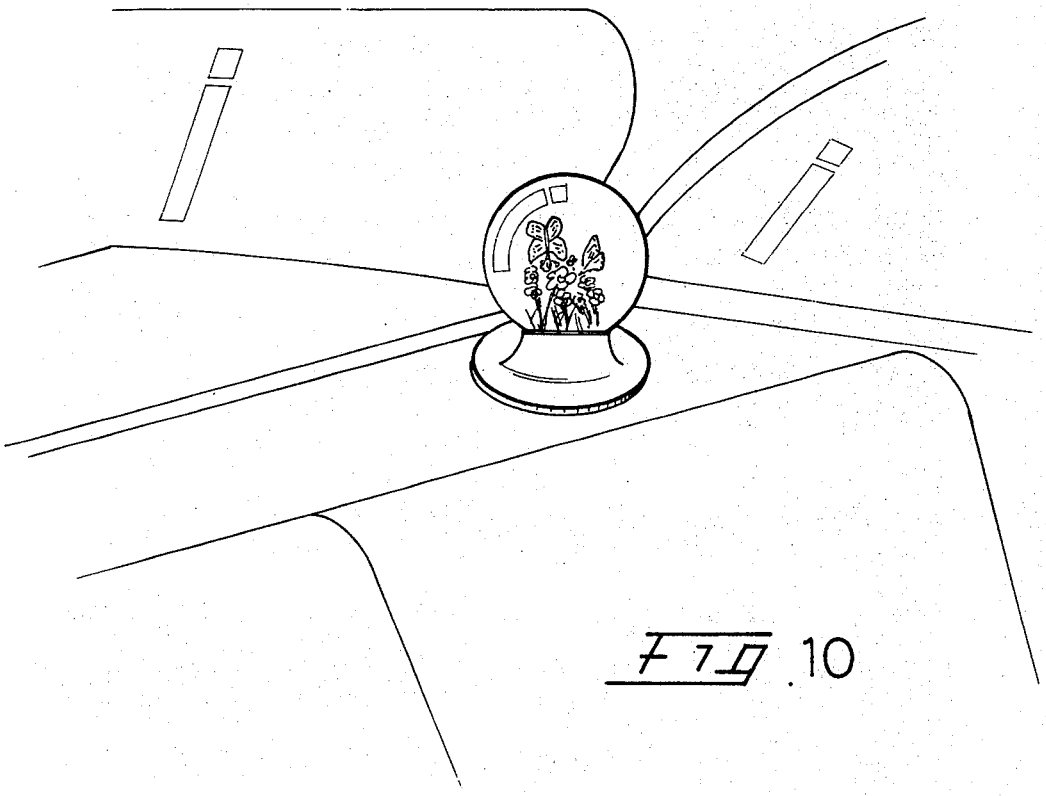
FIG. 10 is an embodiment of this invention provided with sucker disk to cling onto the body of a vehicle.

The illuminating mechanism can be either fixed light source or colored ones, depending on the need of practical use. Take for example, FIG. 6 is an embodiment of this invention functioning as mural ornament, whereas FIGS. 7, 8, 9 are respectively ceiling ornaments, door light, and street lamp. FIG. 10, on the other hand, is an embodiment of this invention equipped with sucker disc to cling onto the surface of such objects undergoing frequent motions such as automobiles, ships, airplanes.

Unlike the conventional vases, the reserved water of the invention is not splashed out easily even in a violent shake, hence it can be applied broadly to many occasions where the former cannot be put in use.

The base board of this invention may also be mounted on a shaft (5) connecting to motor (6) to transmit the rotation to the base board. In so doing, the flowers or ornaments appear in our sight in a dynamic manner to impress us a more realistic and vivacious feeling.

Considering all the above mentioned, this invention obviously preserve all the fortes of contemporary vases and art lamps, and effectively remedies their defects. With the diffusive and absorptive effect of the flowers and ornaments, the glare of light is avoided. Likewise, with the lighting effect, the lifeless, monotonous and insipid flowers and ornaments are greatly enlivened. In this regard, the merit of the invention is not merely an additive effect, but instead, multiplicative effect of the strong points of vases and art lamps. From the point of view, it practicality is undeniable. The patent is therefore solicited.

It is evident that those skilled in this art may now make numerous uses and modifications of and departures from the specific embodiments described herein without departures from the specific inventive concepts. Consequently, the invention is to be construed as embracing each and every novel feature and novel combination of features present in or possessed by the apparatus and techniques herein disclosed and limited solely by the spirit and scope of the appended claims.

What is claimed are:

1. One kind of improved vase-type illuminative device comprising such component parts as transparent container, transparent base board, supporting stand and illuminating mechanism, and is characterized by that both the said transparent container and the transparent base board thereunder can be either fixed or movably mounted together, while the transparent base board is provided with a single or a plurality of holding holes for securing flowers and ornaments, and water inlets equipped with stoppers or threaded covers to close the opening of water inlet.

2. The device in accordance with claim 1, in which the said container and base board can also be mode of translucent material of various kinds of colors instead of transparent one; the colors of both the container and base board is allowed be different, and the latter can be printed various kinds of colors.

3. The device in accordance with claim 1, in which the transparent container is characterized by that its configuration can be open upward and close downward.

4. The device in accordance with claim 1, in which the transparent container is so textured that it allows various kinds of flowers and ornaments be held and liquid of various colors be reserved therein.

5. The device in accordance with claim 1, in which the illuminating mechanism can be either fixed light source or changeable color source.

6. The device in accordance with claim 1, in which the illuminating mechanism can be installed on either the upper portion or the lower portion of said transparent container.

7. The base board in accordance with claim 1 characterized by that one of its side facing to the interior of the container can be installed a single or a plurality of holding holes for holding flowers or ornaments.

8. The base board in accordance with claim 1 characterized by that there can be prepared a heavy metal block below its holding holes.

9. The base board in accordance with claim 1 characterized by that it can be installed a water trough on its underside which intercommunicates with all its holding holes.

10. The base board in accordance with claim 1 characterized by that its underside can be equipped with sucker disc.

11. The base board in accordance with claim 1 characterized by that either itself or its portion for holding flowers and ornaments is rotatable.

12. The base board in accordance with claim 1 characterized by that its holding device for holding flowers or ornaments in place can also be either a plurality of thin rod-like processes standing upright with their top end smooth in the interspace of which the flower and ornaments can be securely clamped therein, or be combination of the rod-like processes and holding holes as mentioned hereinbefore, i.e. there are both said rod-like processes and holding holes on the base board.

13. The base board in accordance with claims 7, 8, 9, 12 characterized by that its lower side can be equipped with sucker disc.

14. The base board in accordance with claim 7, 12 characterized by that its lower side can be equipped heavy metal block, sucker disc or water trough.

15. The transparent base board in accordance with claim 1 characterized by that it can be structurally tubular in shape whereon the flowers or ornaments are secured.

* * * * *